US006392553B1

(12) United States Patent
Mollet et al.

(10) Patent No.: US 6,392,553 B1
(45) Date of Patent: May 21, 2002

(54) SIGNAL INTERFACE MODULE

(75) Inventors: Samuel R. Mollet; David J. Wade, both of Blue Springs, MO (US)

(73) Assignee: Harmon Industries, Inc., Blue Springs, MO (US)

( * ) Notice: Subject to any disclaimer, the term of this patent is extended or adjusted under 35 U.S.C. 154(b) by 0 days.

(21) Appl. No.: 09/643,282

(22) Filed: Aug. 22, 2000

(51) Int. Cl.[7] ..... G08B 21/00

(52) U.S. Cl. ..... 340/642; 340/632; 315/122; 315/224; 315/185 R; 315/185 S

(58) Field of Search ..... 340/642, 514, 340/515, 333, 332; 362/20; 315/224, 307, 308, 360, 97, 122, 185 R, 185 S, 335

(56) References Cited

U.S. PATENT DOCUMENTS 4,654,629 A 3/1987 Bezos et al. ..... 246/473.3
4,668,946 A * 5/1987 Volk et al. ..... 340/641
5,268,635 A * 12/1993 Bortolini et al. ..... 324/96
5,578,998 A * 11/1996 Kasprowicz ..... 340/642
5,757,672 A * 5/1998 Hoepken ..... 364/551.01
6,097,302 A 8/2000 Zinzell ..... 340/815.44

FOREIGN PATENT DOCUMENTS

EP 899178 A1 3/1999
WO PCT/CA00/01380 5/2001

* cited by examiner

*Primary Examiner*—Edward Lefkowitz
*Assistant Examiner*—Davetta W. Goins
(74) *Attorney, Agent, or Firm*—Carl A. Rowold

(57) ABSTRACT

An apparatus and method are provided for interfacing railway controllers with light units, such as LED light unit arrays, to shunt and/or disable test signals not traditionally intended to test non-incandescent light unit arrays.

19 Claims, 3 Drawing Sheets

SIGNAL INTERFACE MODULE

FIELD OF THE INVENTION

The present invention relates to a light unit operating apparatus. Specifically, the present invention provides an apparatus and method for interfacing a railway signal controller with a light unit.

BACKGROUND OF THE INVENTION

Colored signal light units are commonly used in railway control systems to signal the train crews as to route availability and speed requirements in the forthcoming area of railway track. Typically, incandescent light units are used as the source of light, with color added by using external colored lenses. However, non-incandescent light units, such as light emitting diode (LED) light units, are a desirable substitute as they provide a longer life, lower power consumption, and better visibility than incandescent light units. An LED light unit typically consists of a two-wire input, a power supply and a plurality of LEDs electrically connected in an array.

Electrical or electronic controllers housed in bungalows and located alongside railroad tracks may control many sets of light units, whether incandescent or LED. These controllers often employ light unit integrity tests to verify that the light unit is working, or is able to work when required. Traditionally, these controllers control and monitor incandescent light units. Traditional signal integrity testing consists of at least two separate tests performed by the controller. The first test is the cold filament test (CFT) which is applied to light units that are not currently energized. This test consists of pulses, typically less than two milliseconds in duration but repeated periodically at intervals of several seconds, which pulse the filament of the unenergized incandescent light unit. When the controller's test signal detector senses an adequate current draw during this CFT test pulse, the controller registers that the incandescent bulb passes the CFT. If the controller does not sense an adequate current draw during the CFT test pulse, the controller registers a failed CFT. The controller also performs a hot filament test (HFT), which is applied to light units that are currently energized. The HFT provides that the light unit is periodically monitored for adequate current draw during the times that the light unit is supposed to be energized. In the event of a loss of electrical continuity between the controller and the light unit or an open filament in an incandescent light unit, both CFT and HFT tests fail.

Traditionally, when incandescent bulbs are pulsed with the CFT pulse, the slow warm-up time of the filament is such that there is no visible light output as a result of the test. However, light emitting diodes react much faster than incandescent bulbs. When this test pulsing is applied to an LED light unit it may cause a perceivable visible blink. Those familiar with the art will appreciate that this unintended blinking is an unacceptable condition.

The present invention allows quick responding non-incandescent light units to be used interchangeably with, or as replacements for, incandescent light units. The present invention also allows using the currently employed controllers utilizing the standard CFT and HFT processes, yet avoiding any undesirable blinking of the non-incandescent light units. The present invention further allows this to be accomplished without losing the ability of both the CFT and the HFT to verify electrical continuity between the controller and the light unit.

SUMMARY OF THE INVENTION

The present invention overcomes the above mentioned problems and limitations of the prior art devices by providing an apparatus and method to test the functional status of non-incandescent light units using existing controllers.

One of the preferred embodiments of the present invention includes: receiving circuitry for receiving a test signal intended for transmission to the light unit and for receiving an energizing signal; circuitry coupled to the receiving circuitry to shunt the test signal away from the light unit; circuitry for analyzing a response of the light unit to the energizing signal to determine a non-functional light unit state; and circuitry for disabling the shunting circuitry upon determination of the non-functional light unit state.

An embodiment may include the suppression of the test signal from transmission to the light unit.

The present invention provides for a signal interface module (SIM) which interfaces a quick responding non-incandescent light unit with a controller. Use of the signal interface module allows non-incandescent lights and incandescent bulbs to be driven and monitored from the same controller interchangeably, with no changes to the operation of the controller itself.

It is desired that the controllers drive and monitor non-incandescent light units while still performing both cold filament testing, and hot filament testing. Therefore, when using a non-incandescent light unit, the cold filament test pulse which otherwise could cause a visible blink of the non-incandescent light unit is shunted away from the non-incandescent light unit. A shunt completes the circuit at the SIM allowing for the detection of current flow at the controller. Thus, the present invention allows for the non-incandescent light units to be shunted during the CFT, and for no visible blinking of the non-incandescent light unit to occur, whereas if the controller is connected directly to incandescent units, the incandescent units will be subject to both cold filament tests and hot filament tests in the normal manner.

Simply shunting the light unit for the CFT would allow for the controller to continue to send CFT test pulses if the light unit has failed the HFT test. Therefore, if the non-incandescent light unit is shunted for the CFT, but no other precautions are taken, a non-functional status of the non-incandescent light unit would result in alternating status determined at the controller. The HFT would indicate light unit failure, and cause the controller to de-energize the failed light unit. The controller would then revert to CFT of the failed light unit, which may yield a "light unit OK" status, and allow the controller to again attempt to energize the light unit, repeating the cycle indefinitely.

An objective of this invention is to provide a consistent response to the controller in the event that the non-incandescent light unit is non-functional. When the non-incandescent light unit is functioning properly, the CFT will be shunted around the non-incandescent light unit when the light unit is de-energized, and the controller will sense an adequate current flow during the CFT. In the event that the non-incandescent light unit is not functioning properly, therefore not drawing an adequate current during the receipt of the energizing signal, the present invention employs a latch to be set, which will disable the flow of current during the CFT, causing the controller to register a failure on the next CFT. Thus, if the light unit is non-functional, the shunt of the CFT pulse is disabled and the controller will recognize a failed CFT during the next CFT therefore indicating a failed light unit under the CFT.

This application could be applied to other forms of light unit testing, such as testing of automobile traffic signals or harbor traffic signals.

An objective of this invention is to prevent the blinking effect inherent in a cold filament test of the non-incandescent light unit.

Another objective of this invention is to maintain the use of or the validity of the CFT to verify electrical continuity between the controller and a location adjacent to the light unit such as the light unit enclosure, even though the CFT is shunted around the non-incandescent light unit. This can be achieved by locating the invention adjacent to the light unit such as inside the light unit enclosure. By placing the invention near the light unit the CFT signal must travel to the adjacent location and return, therefore verifying the integrity of the electrical continuity between the controller and the adjacent location.

Another objective of the present invention is to provide for operation of the non-incandescent light unit testing over a broad range of operating voltages.

Also an objective of the invention is to provide a signal interface unit in which the signal interface unit could sense damage of its own circuitry so as to shut down in the event of damage to the circuitry.

The foregoing and other objects of the invention are intended to be illustrative of the invention and are not meant in a limiting sense. Many possible embodiments of the invention may be made and will be readily evident upon a study of the following specification and accompanying drawings comprising a part thereof. Various features and sub-combinations of the invention may be employed without reference to other features and sub-combinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF A PREFERRED EMBODIMENT

Figure 1:
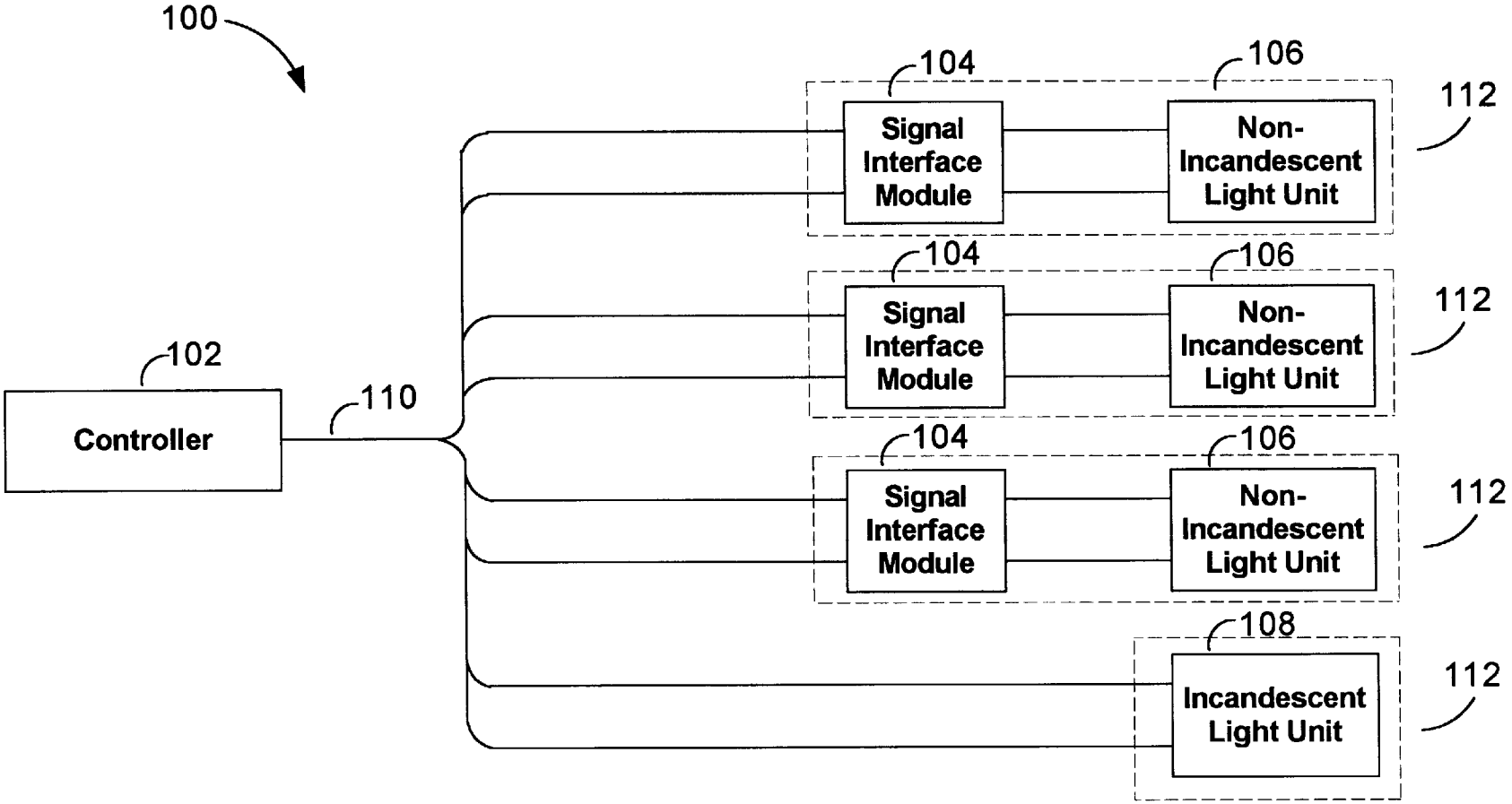
FIG. 1 is a simplified block diagram of a train signal controller system having the present invention mounted therein.

Referring now to FIG. 1, a railway signal and controller combination 100 constructed in accordance with the present invention is illustrated. Controller 102 is used to monitor and control various devices including signal lights. Interconnecting cable 110 is used to connect signal lights, each being in its own enclosure 112, to the controller 102. Traditional systems employ incandescent light units 108 for the signals. The incandescent light units 108 are wired directly to the controller 102 through cable 110. In the present invention, a signal interface module 104 is employed in combination with non-incandescent light unit 106 to provide an apparatus and method for testing the functional status of non-incandescent light unit 106 by receiving and processing signals from a controller 102. The controller could be a solid state controller such as a Harmon Industries, Inc. Vital Harmon Logic Controller (VHLC), ElectroCode 4, ElectroCode 5, or ElectroLogic 1. A light unit could be a light emitting diode (LED) unit such as a 45-45263 manufactured by RSO, Inc.

Signal interface module (SIM) 104 includes: receiving circuitry for receiving a test signal intended for transmission to the light unit and for receiving an energizing signal; circuitry coupled to the receiving circuitry to shunt the test signal away from the light unit; suppression circuitry for suppressing the test signal from transmission to the light unit; circuitry for analyzing a response of the light unit to the energizing signal to determine a non-functional light unit state; and circuitry for disabling the shunting circuitry upon determination of the non-functional light unit state.

Figure 2:
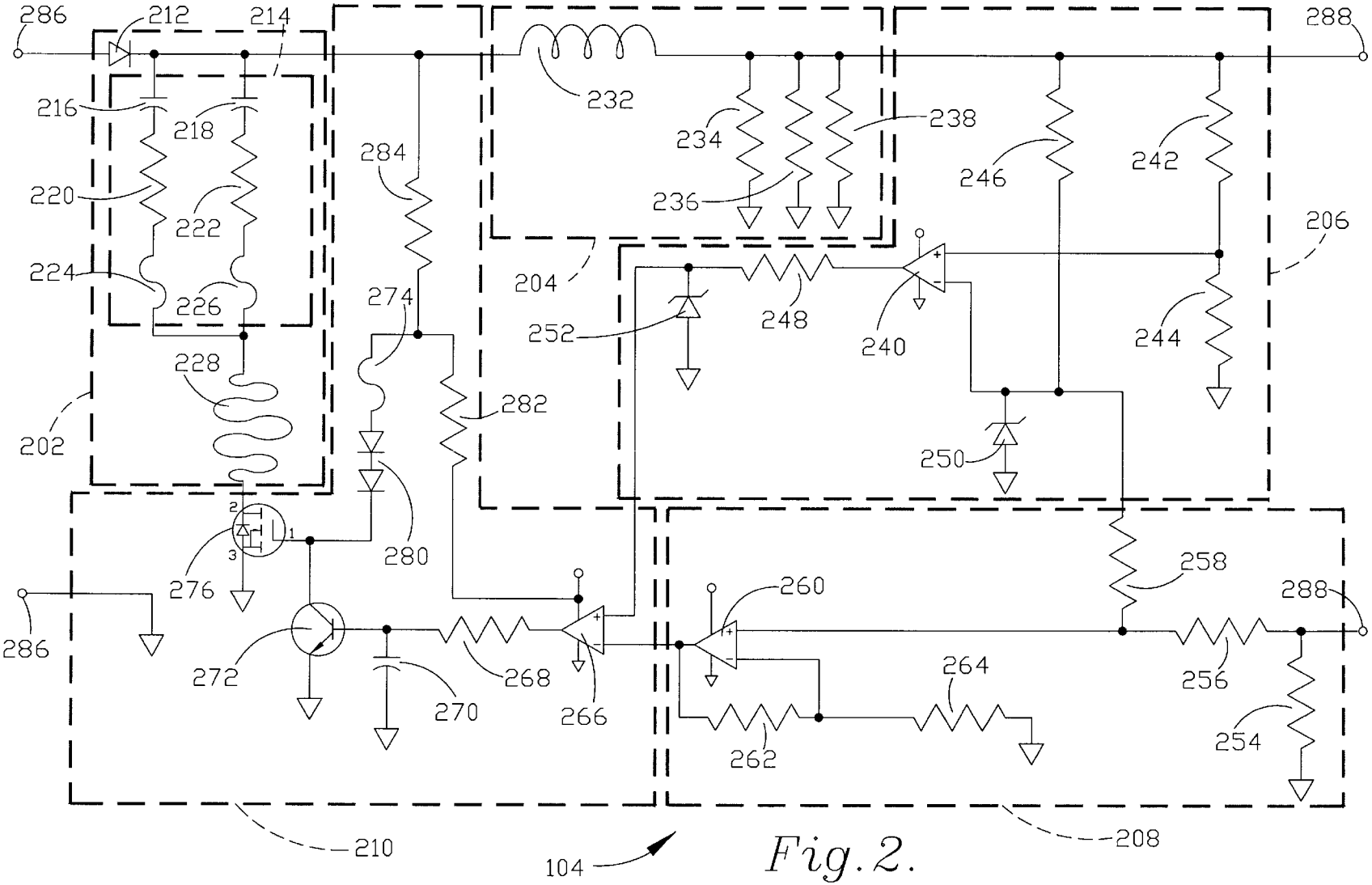
FIG. 2 is a schematic diagram with overlaid phantom line groupings showing the signal interface module constructed in accordance with a preferred embodiment of the invention.

Referring now to FIG. 2, a preferred embodiment is shown. SIM 104 is connected to controller 102 via interconnecting cable 110 at receiving terminals 286. SIM 104 is connected to light unit 106 at light unit terminals 288. A cold filament test (CFT) emulation circuit 202 shunts the CFT signal away from light unit 106 provided that the light unit has not been previously found to be in a non-functional state. CFT function latch circuit 210 disables the shunting of the CFT signal away from the light unit upon determination of the non-functional light unit state. The CFT emulation circuit is referred to as an emulation circuit because the response of a traditional light unit having a filament is being emulated by the present invention during the CFT. In a preferred embodiment, a CFT signal may be a pulse or series of pulses each of a duration typically less than 2 msec at an amplitude of 11–14 volts. CFT pulse suppression circuit 204 adds pulse suppression of the CFT test signal in addition to the shunt of the CFT test signal. Voltage sense circuit 206 senses for voltage at the light unit. Current sense circuit 208 senses for current through the light unit. When the energizing signal is present, CFT function latch circuit 210 analyzes information from voltage sense circuit 206 and current sense circuit 208 to determine the functional or non-functional state of the light unit 106.

In more detail, in FIG. 2, CFT emulation circuit 202 shunts the CFT signal away from the light unit. CFT emulation circuit 202 includes diode 212 which prevents any discharge back from capacitors 216, 218. Capacitor shunt 214 includes capacitors 216, 218, resistors 220, 222 and fuses 224, 226 to provide for the shunt of the CFT signal. The capacitors are sized as to shunt the CFT signal received from a specific controller for the duration of the CFT signal pulse. In a preferred embodiment, diode 212 could be a Fairchild Semiconductor, part number S3M, and capacitors have been sized to 4700 microfarads. Although electrically only one leg of the shunt is required, two legs are used for a duplicating effect to protect against component failure. Fuses 224, 226 are present to prevent the controller from viewing the circuit as a closed loop in the event of a short circuit failure across one or both capacitors. Resistors 220, 222 are 5.6 Ohm and fuses 224, 226 are rated at 0.375 amps in this embodiment. Serpentine trace 228 is wound through the circuitry of SIM 104. In the event of physical damage to SIM 104 and thus serpentine trace 228, the current through CFT emulation circuit 202 will be inhibited due to a loss of conductivity through serpentine trace 228 and the controller will not detect a proper response to the CFT signal. Serpentine trace 228 could be positioned at other locations in the invention, including in current sense circuit 208. Therefore, after determining the existence of circuit damage, the invention inhibits the shunt. Although, in this embodiment, loss of conductivity through a conductor indicates circuit damage, circuit damage also can be determined in different ways, such as current sensing devices.

Further in FIG. 2, CFT pulse suppression circuit 204 adds pulse suppression of the CFT test signal in addition to the previously discussed shunt of the CFT signal by CFT emulation circuit 202. The CFT signal is suppressed, but may appear at the light unit as a reduced voltage pulse. A voltage of less than 2.5 volts is used in a preferred embodiment. Inductor 232 in combination with resistors 234, 236, 238 perform the suppression function. In a preferred embodiment the inductor is sized to suppress the CFT signal to a level below 2.5 volts which is below the activation threshold of the LED light unit. By the way of example, inductor 232 of pulse suppression circuit 204 has an inductance of 1.5 Henries with a core material of 80% nickel and 20% silicon. Inductor 232 is designed such that the core saturates after approximately 2 msec of energizing. This saturation allows for the passage of signals longer in duration than the 2 msec CFT signal. Resistors 234, 236, 238 provide for a reset of stored energy in inductor 232 and capacitors 216, 218. To reduce the probability of failure, three resistors are used instead of one. Although one resistor would electrically be sufficient, multiple resistors are used in this embodiment to avoid failure if one or two should fail. Preferred resistors include pulse rated metal film resistors of 150 Ohms each.

Voltage sense circuit 206 includes comparator 240 which provides for a positive output when the output of the signal interface module 104 meets or exceeds a specified voltage. In a preferred embodiment this voltage is 8 volts. An example of a comparator is one of the operational amplifiers on an Analog Devices device, part number OP491. Voltage sense current 206 includes resistors 242, 244 forming a voltage divider. Resistors 242, 244 are preferably, 10.0 kOhms and 4.53 kOhms, respectively. Resistor 246 provides a bias current for voltage reference 250 and could be a 10 kOhm metal film resistor. Resistor 248 limits the bias current through voltage reference 252. Resistor 248 could also be a 10 kOhm metal film resistor. Precision voltage reference 250 provides a constant voltage at the input of comparator 240, while precision voltage reference 252 provides for a constant voltage output of comparator 240 when comparator output is in a high state. Precision voltage references 250, 252 in a preferred embodiment are Motorola, part number LM285, 2.5 VDC.

Current sense circuit 208 outputs a voltage proportional to the current flowing through light unit 106. Resistor 254 is a sensing resistor. A representative value for resistor 254 is 0.1 Ohm in a preferred embodiment. Resistor 256 is part of a voltage divider to provide DC offset and could be a 4.99 kOhm resistor. Resistor 258 provides for a DC offset on the positive input of amplifier 260 in order to raise input voltage level to amplifier 260 above a noise margin of 25 mV. Amplifier 260 is designed in this embodiment in a non-inverting configuration with a gain of approximately 20 to amplify the voltage across the resistor 254. The output of amplifier 260 is 2.5 VDC or greater when light unit 106 is functional and energized. Resistors 262 and 264 used to the set the gain of the amplifier configuration and could be 95.3 kOhms and 4.99 kOhms, respectively. Resistor 258 could be 499 kOhms. Amplifier 260 could be an operational amplifier in an Analog Devices device, part number OP491.

CFT function latch circuit 210 compares the outputs of voltage sense circuit 206 and current sense circuit 208 and disables CFT emulation circuit 202 from shunting the CFT signal in the event of a non-functioning light unit 106. The non-functional state of light unit 106 is determined if light unit 106 is receiving a specified voltage (the output of comparator 240 is high) and inadequate current is flowing through light unit 106 (the output of amplifier 260 is below the level of a functional light unit). When these two events co-exist, the output of comparator 266 is high. Resistor 268 and capacitor 270 are part of a delay circuit used to slow down the turn on time of the base-emitter junction of n-channel BJT transistor 272. A high output on comparator 266 turns on transistor 272. Current flows through transistor 272 and causes fast acting fuse 274 to open. Because fuse 274 is open, MOSFET 276 is not activated during the CFT and does not shunt current. Therefore, CFT emulation circuit 202 is not allowed to shunt the CFT. Small signal diode pair 280 prevents current through fuse 274 during power up periods of the comparator 266. Resistor 282 limits current to comparators 240, 266 and amplifier 260 in the event of a component short internal to the IC chip. Resistor 284 limits the current through fuse 274 during the CFT pulse. In a preferred embodiment transistor 272 is an On Semiconductor MMBT3904, MOSFET 276 is a Fairchild Semiconductor IRFW540A, capacitor 270 is 47 microfarads, resistor 282 is 243 Ohms, resistor 284 is 51 Ohms and resistor 268 is 1.0 kOhms. Diode pair 280 is an On Semiconductor MMBD7000LT1. An example of comparator 266 is one of the operational amplifiers on an Analog Devices device, part number OP491.

As is apparent to one skilled in the art, even in this embodiment, components could be substituted for those stated. For example, the fast acting fuse could be replaced with a resettable device.

As is also apparent, the invention could be practiced in many alternative embodiments. For example, a microprocessor or microcontroller could perform many of the functions of the illustrated embodiment.

Also, although a preferred embodiment refers to a CFT signal, a person skilled in the art recognizes that the circuit could be configured to recognize many different varieties of test signals.

Also, although a preferred embodiment is shown where LEDs are used for the non-incandescent light units other types of light units could be used.

Figure 3:
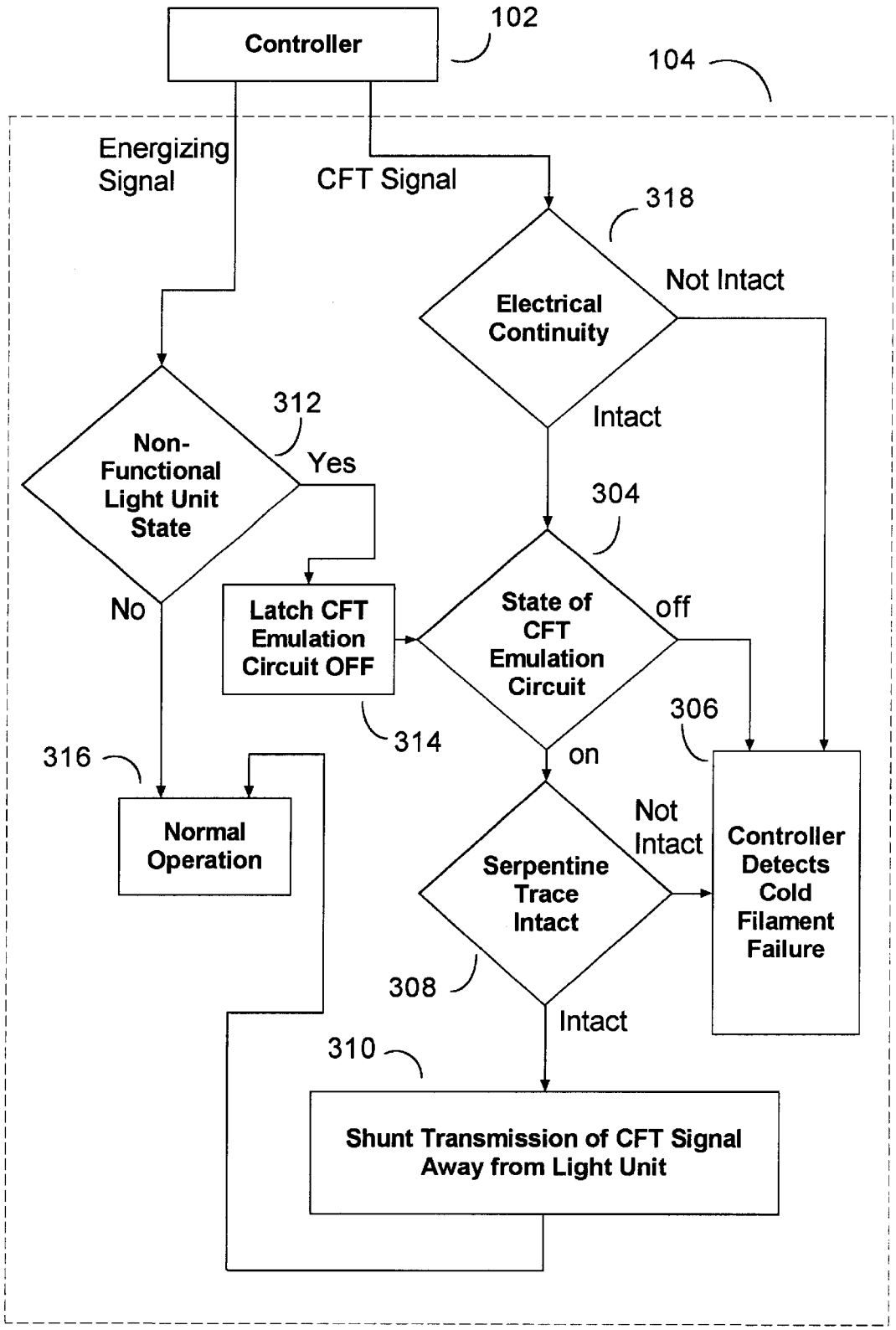
FIG. 3 is a flow chart showing a test and an energizing signal application to the invention.

Referring now to FIG. 3, the flow chart shows a CFT and an energizing signal applied to signal interface module (SIM) 104. Controller 102 generates signals that are transmitted to SIM 104. When a CFT signal is being transmitted to SIM 104, if decision function 318 is not intact, indicating that electrical continuity between controller 102 and a location, containing at least a portion of SIM 104, adjacent to light unit 106 is not intact, controller 102 detects a CFT failure.

If electrical continuity between controller 102 and a location, containing at least a portion of SIM 104, adjacent to light unit 106 is intact, decision function 318 allows the continued shunt of the CFT signal. In this case, controller 102 detects no CFT failure and a functional light unit 106.

If decision function 304 of CFT emulation circuit 202 (FIG. 2) is "off", the shunting of the CFT signal away from light unit 106 (FIG. 1) is interrupted and controller 102 detects a CFT failure.

If decision function 304 of CFT emulation circuit 202 is "on", function 304 directs the shunting of the CFT signal away from light unit 106 (FIG. 1). In this event, controller 102 indicates a functional light unit 106 (FIG. 1).

Decision function 308 relies upon the intact condition of serpentine trace 228 (FIG. 2) to indicate that SIM 104 circuitry is intact. As previously stated, serpentine trace 228 is wound about the circuitry of SIM 104. If serpentine trace 228 is damaged, it is likely that SIM 104 circuit components or circuit mounting devices are damaged potentially impairing their proper operation. In such a case, function 308 will inhibit the flow of current during the CFT, causing the controller 102 to register a non-functional light unit 106.

If the serpentine trace is not damaged, function 310 allows the continued shunt of the CFT signal away from light unit 106. In this case, controller 102 detects no CFT failure and a functional light unit 106. In this condition, normal operation of controller 102, SIM 104 and light unit 106 continues as shown at function 316.

When controller 102 determines a light unit 106 should be illuminated it transmits an energizing signal to SIM 104. Function 312 analyzes a response of light unit 106 (FIG. 1) to the energizing signal to determine if light unit 106 is functional or non-functional. In a preferred embodiment, if comparator 266 finds sufficient voltage and yet inadequate current at light unit 106, a non-functional light unit condition is determined. If light unit 106 is determined to be non-functional, function 314 latches CFT emulation circuit 202 (FIG. 2) into an "off" state. By latching CFT emulation circuit 202 to "off," the shunting of the CFT is disabled. This then, changes the state of function 304 to effect the next CFT signal and indicate light unit failure at the next CFT.

If function 312 determines a functional light unit state, then normal operation of controller 102, SIM 104 and light unit 106 continues as shown at function 316.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive apparatus is constructed and the method which is disclosed, the characteristics of the construction, and advantageous, new and useful results obtained; the new and useful methods, structures, devices, elements, arrangements, parts and combinations, are set forth in the appended claims.

It is understood that the following claims are intended to cover all of the generic and specific features of the invention herein described, and all statements of the scope of the invention which, as a matter of language, might be said to fall therebetween.

Having thus described the invention what is claimed as new and desired to be secured by letters patent is as follows:

1. A method of testing the functional status of a light unit with a test signal intended for transmission to the light unit from a controller having a test signal detector therein, the method comprising the steps of:

receiving the test signal, shunting the test signal away from the light unit, receiving an energizing signal, analyzing a response of the light unit to the energizing signal to determine a non-functional light unit state, and disabling the shunting step upon the determination of the non-functional light unit state.

2. The method as claimed in claim 1, further comprising the step of inhibiting the shunting step upon physical damage which prevents execution of the analyzing or disabling steps.

3. The method as claimed in claim 1, further comprising the step of performing the method steps at a location adjacent to the light unit to allow use of the test signal to verify electrical continuity between the controller and the adjacent location.

4. The method as claimed in claim 1, further comprising the step of suppressing the test signal from transmission to the light unit.

5. The method as claimed in claim 4, further comprising the step of inhibiting the shunting step upon physical damage which prevents execution of the analyzing or disabling steps.

6. A method of avoiding illuminating a non-incandescent light unit in response to a test signal comprising the steps of:

receiving the test signal intended for transmission to the light unit, and shunting the test signal away from the light unit.

7. The method as claimed in claim 6, further comprising the step of suppressing the test signal from transmission to the light unit.

8. An apparatus for use with testing the functional status of a light unit with a test signal intended for transmission to the light unit from a controller having a test signal detector therein, comprising:

circuitry for receiving a test signal, circuitry coupled to the receiving circuitry for shunting the test signal away from the light unit, circuitry for analyzing a response of the light unit to the energizing signal to determine a non-functional light unit state, and circuitry for disabling the shunting upon determination of the non-functional light unit state.

9. The apparatus as claimed in claim 8, wherein at least a portion of the circuitry is located adjacent to the light unit to allow use of the test signal to verify electrical continuity between the controller and the adjacent location.

10. The apparatus as claimed in claim 8, further comprising circuitry coupled to the shunting circuitry for inhibiting the shunting upon physical damage to the apparatus.

11. The apparatus as claimed in claim 8, further comprising suppression circuitry coupled to the receiving circuitry for suppressing the test signal from transmission to the light unit.

12. The apparatus as claimed in claim 11, further comprising circuitry coupled to the shunting circuitry for inhibiting the shunting upon physical damage to the apparatus.

13. An apparatus for avoiding illuminating a non-incandescent light unit comprising:

circuitry for receiving a test signal intended for transmission to the light unit, and circuitry coupled to the receiving circuitry for shunting the test signal away from the light.

14. The apparatus as claimed in claim 13, further comprising suppression circuitry coupled to the receiving circuitry for suppressing the test signal from transmission to the light unit.

15. A train signal controller system comprising:

receiving circuitry for receiving a test signal intended for transmission to a light unit and for receiving an energizing signal, circuitry coupled to the receiving circuitry to shunt the test signal away from the light unit, circuitry for analyzing a response of the light unit to the energizing signal to determine a non-functional light unit state, and circuitry for disabling the shunting upon determination of the non-functional light unit state.

16. The train signal controller system as claimed in claim 15, further comprising suppression circuitry for suppressing the test signal from transmission to the light unit.

17. The train signal controller system as claimed in claim 15, wherein the light unit is a light emitting diode (LED) unit.

18. The train signal controller system as claimed in claim 17, wherein the test signal is a cold filament test signal.

19. The train signal controller system as claimed in claim 15, further comprising circuitry coupled to the shunting circuitry for inhibiting the shunting upon physical damage to the apparatus.

* * * * *